US006206714B1

(12) United States Patent
Bernardini

(10) Patent No.: US 6,206,714 B1
(45) Date of Patent: Mar. 27, 2001

(54) PLUG AND ADAPTER FOR EXISTING SINGLE POLE ELECTRICAL RECEPTACLE

(75) Inventor: Allen J. Bernardini, Southbury, CT (US)

(73) Assignee: Litton Systems, Inc., Woodland Hills, CA (US)

( * ) Notice: Subject to any disclaimer, the term of this patent is extended or adjusted under 35 U.S.C. 154(b) by 0 days.

(21) Appl. No.: 09/243,381

(22) Filed: Feb. 1, 1999

(51) Int. Cl.[7] ..... H01R 4/50; H01R 13/625
(52) U.S. Cl. ..... 439/335; 439/166
(58) Field of Search ..... 439/335, 332, 439/750, 452, 738, 449, 660, 670, 671

(56) References Cited

U.S. PATENT DOCUMENTS 5,423,692 * 6/1995 Francis ..... 439/335

* cited by examiner

*Primary Examiner*—Lincoln Donovan
*Assistant Examiner*—Brian S. Webb
(74) *Attorney, Agent, or Firm*—Lowe Hauptman Gilman & Berner

(57) ABSTRACT

A plug and an adapter are provided for use with an existing electrical receptacle which has a sleeve extending from a mounting base, with a conductive pin within the sleeve. The adapter has a cylindrical collar receivable snugly over the sleeve of the receptacle, and includes a flange for maintaining the collar in a predetermined position on the sleeve. The plug is elongate, with a first end having a recess for receiving the cylindrical collar, the first end also having an electrically conductive contact member to engage the contact pin. The plug and adapter include retaining means for retaining the plug to the adapter and to permit selective engagement of a plug and retaining means to prevent making incorrect connections between selected plugs and electrical receptacles. The plug further includes attachment means for connection to a cable.

13 Claims, 2 Drawing Sheets

PLUG AND ADAPTER FOR EXISTING SINGLE POLE ELECTRICAL RECEPTACLE

The present invention relates generally to electrical connectors, and has to do particularly with single-pole connectors intended for high current applications.

BACKGROUND OF THE INVENTION

High current capacity single-pole electrical connectors have tended to be difficult to assemble and cumbersome in use, particularly where connecting and disconnecting must be frequently accomplished.

Currently available on the market is a widely used, high-power, single-pole connector plug and receptacle connector set identified as the Cam-Lok®, E-Series. This connector set has been in use for over fifty years and is sold by the Crouse-Hinds Division of Cooper Industries. The receptacle is used with a mating straight plug. Both the receptacle and the plug of the Cam-Lok®, E-Series connector set are rubber sheathed for purposes of environmental sealing, electrical insulation for operator safety, and to provide a good gripping surface for manual connection and disconnection. The Cam-Lok®, E-Series receptacle includes a non-conductive, plate-like mounting base which appears square in plan view, a non-conductive, substantially cylindrical sleeve extending integrally from the mounting base, and a conductive contact pin positioned coaxially within the sleeve and usually having a threaded shank extending out of the unit on the side opposite the sleeve. Openings are provided adjacent the corners of the mounting base, to allow passage of fasteners such as bolts, rivets, etc. for fastening the receptacle to a mounting surface.

The leading end of the mating straight plug of the Cam-Lok®, E-Series connector set typically has a forwardly converging, conical configuration. This allows it to fit inside the cylindrical sleeve of the receptacle and achieve a slight pressure fit which provides a moisture seal. Within the conical leading end of the conventional plug is the end of an electrically conductive contact member which is cylindrical in configuration, with an axial opening adapted to snugly receive the contact pin within the receptacle sleeve. (This assumes the receptacle is the "hot" side of the circuit (source) and the plug is the cold side (drain). However, the gender can be reversed with a different plug and receptacle combination). This electrical contact involves geometries (explained below) which provide a cam action to achieve a secure, low resistance electrical connection. Although the rubber sheaths of the plugs are color-coded to identify ground, neutral, and three electrical phases, this conventional design contains no provision to prevent inadvertent cross-plugging of connectors, that is for example, plugging a phase cable into a neutral or ground connector.

In the conventional Cam-Lok®, E-Series construction, the cable is attached to the contact member on the plug side by way of set screws. The Cam-Lok® design also typically uses an internal wire to grip the jacket of the cable for providing strain relief.

SUMMARY OF THE INVENTION

It is an object of one aspect of this invention to provide an intermateable, keyed adapter and a mating plug which can be used with an existing Cam-Lok® receptacle connector, in order to achieve a secure, safer connection between the mating plug and the original Cam-Lok® connector receptacle.

More specifically, this invention provides a plug and an adapter for use with an existing single pole electrical receptacle. The receptacle includes a non-conductive mounting base a non-conductive, substantially cylindrical sleeve extending from the mounting base, and a conductive contact pin positioned generally coaxially within the sleeve. The adapter has a generally cylindrical collar snugly receivable over the sleeve of the existing Cam-Lok® receptacle, and includes means for maintaining the collar in a predetermined position on the sleeve. The plug of the instant invention is elongate and has first and second ends, the first end defining a substantially cylindrical recess sized to snugly receive the cylindrical collar, and a first end enclosing an electrically conductive contact member which conductively engages the contact pin when the first end of the plug receives the collar. The plug further has attachment means for connection to a cable, the attachment means establishing an electrical connection between the cable and the contact member, and thus between the cable and the contact pin. The plug and adapter also include means for retaining one end of the plug in a desired position with respect to the collar.

The invention also provides a plug and a single pole electrical receptacle comprising a non-conductive mounting base, a non-conductive, substantially cylindrical sleeve extending from the mounting base, and a conductive contact pin positioned generally coaxially within the sleeve, and an adapter having a generally cylindrical collar snugly receivable over the sleeve of the receptacle, and including means for maintaining the collar in a predetermined position on the sleeve.

The plug is elongate and has first and second ends, the first end defining a substantially cylindrical recess sized to receive the cylindrical collar. The first end of the plug encloses an electrically conductive contact member which conductively engages the contact pin when the first end of the plug receives the collar. The plug also has attachment means for connection to a cable, the attachment means establishing an electrical connection between the cable and the contact member, and thus between the cable and the contact pin. The plug and adapter also include means for retaining the end of the plug in a desired position with respect to the collar.

BRIEF DESCRIPTION OF THE DRAWINGS

The foregoing and other objects, features and advantages of the invention will be apparent from the detailed description of a preferred embodiment disclosed herein, as illustrated in the accompanying drawings in which like reference numbers refer to the same parts throughout the different views.

DETAILED DESCRIPTION OF A PREFERRED EMBODIMENT

Figures 1, 2, 3:
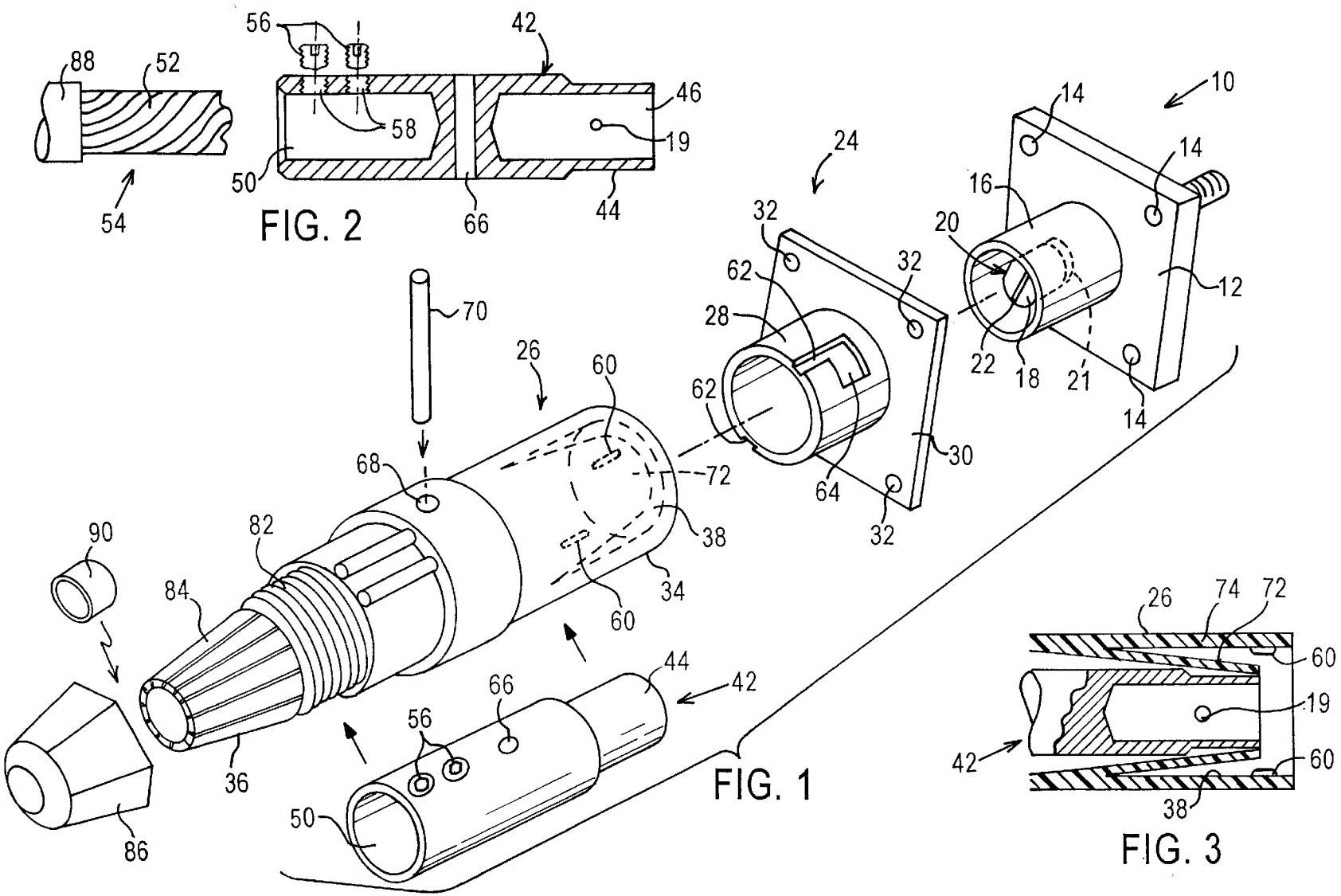
FIG. 1 is an exploded perspective view showing the existing connector, the adaptor provided herein, and a plug specially constructed for use with the adaptor and/or the existing connector receptacle, and further showing an internal conductive element normally mounted within the plug.
FIG. 2 is an axial section view through the conductive element, showing its main features.
FIG. 3 is a partial axial sectional view of the front end of the plug provided herein.

In FIG. 1 at the right, an existing electrical receptacle or connector 10 is illustrated. It includes a non-conductive mounting base 12 which is in the form of a square plate with mounting apertures 14 at the four corners. The connector 10 further includes a non-conductive, substantially cylindrical sleeve 16 extending centrally and integrally from the base 12. Additionally, the connector 10 includes a conductive contact pin 18 positioned generally coaxially within the sleeve 16.

The pin 18 has a cut-away portion or "flat" 20 which extends axially along the pin 18 from the outer end to a gallery or circumferential groove 21 in the contact pin 18. Groove 21 is eccentric in configuration for a purpose which will later be explained. This allows the contact pin to be secured to a contact member in the form of a cylinder adapted to receive the end of the contact pin 18 and having an inward protuberance 19 adapted to slide down along the flat 20 to the location of the groove 21, whereupon rotation brings the protuberance into the groove 21 at a circumferential position from which it cannot be directly withdrawn without rotation. This accomplishes a cam action-type locking-together of the two parts. To improve the ease of connection, the contact pin 18 is bifurcated by virtue of a longitudinally and diametrally extending slot 22.

Provided by the present invention is an adapter 24 which is designed in such a way as to cooperate with the connector 10, in turn to improve securement to a plug 26 (which will be described below).

As can be seen, the adapter 24 has a generally cylindrical collar 28 which is sized to be snugly received over the sleeve 16 of the receptacle 10. The adapter further has means for maintaining the collar 28 in a predetermined position on the sleeve 16, constituted by a flange member 30 which is integral with the collar 28 and has an opening corresponding to the hollow center of the collar 28, allowing the sleeve 16 of the receptacle 10 to be received into the collar 28 from behind. It will be further noted that the flange member 30 has apertures 32 which register with the apertures 14 when the flange member 30 is placed against the base 12, with the sleeve 16 received snugly within the collar 28.

Attention is now directed to the plug 26, which is elongate and has a first end 34 and a second end 36. The first end 34 defines a substantially cylindrical recess 38 adapted to snugly receive the cylindrical collar 28 of the adapter 24 with a slip-fit.

FIG. 2 illustrates a conductive member 42, lying beside the plug 26. This positioning of the member 42 is merely for clarity, since in operation the member 42 would be locked into a coaxial position inside the plug 26, having the configuration shown in FIG. 3.

Looking at FIGS. 1 and 2, the conductive elongate member 42 has, at its rightward end, an electrically conductive contact member 44, which is cylindrical in configuration and has an internal opening 46 which is adapted to snugly receive the conductive contact pin 18 which is part of the existing electrical receptacle 10. The slot 22 in the pin 18, as aforesaid, allows the bifurcated contact pin 18 to yield in such a way as to provide good electrical contact with the elongate member 42.

A recess 50 is provided at the other end of the elongate member 42, the opening of recess 50 being sized to receive the bared end 52 of a cable 54. Two threaded fasteners 56 are adapted to be screwed into threaded bores 58, once the end 52 of the cable 54 is in place, thereby obtaining a secure mechanical lock and electrical communication between the cable 54 and the elongate member 42. The two screw method of termination is shown for illustration purposes. Other termination methods exist. For example: solder and crimp. These other termination methods can also be used without departing from the spirit and scope of the subject invention.

Means are provided for ensuring that the plug 26 can be connected only with the correct sleeve 16. Specifically, the plug 26 provides two inward protuberances 60 which are adapted to be received simultaneously along axial external grooves 62 on the collar 28, each groove 62 communicating with a circumferentially extending grooved portion 64. The position of the protuberances 60 and the grooves 62 is such that engagement of protuberances 60 and grooves 62 takes place at the same time as the protuberance 19 within internal opening 46 engages the flat 20 of the contact pin 18 and, the protuberance 19 coming to rest in the circumferential groove 21 of the pin 18 at the same time as the protuberances 60 reach the grooved portions 64 of the collar 28.

To ensure that only one plug and adapter can be mated to each other (thereby preventing "cross-plugging" with the wrong plug and adapter being mated together) plugs and adapters can be provided with different numbers of protuberances 60 and grooves 62 or the radial distance between protuberances 60 and grooves 62 can be changed to ensure that only one plug and adapter will mate.

When the plug 26 is mated with connector 10, there is a cam action provided since groove 21 is eccentric and pin 19 slides up the groove as plug 26 is rotated after protuberance 19 is seated within groove 21. The rotation of plug 26 causes the diametrally extended slot 22 to be compressed. Engagement of the protuberances 60 with grooved portions 64 of the collar 28 occurs as a result of rotation of the plug after the protuberances 60 have fully traveled the length of grooves 62 when the plug is fully engaged with the adapter 24.

In order to secure the member 42 within the plug 26, the member 42 is provided with a diametral bore 66 and the plug 26 is provided with a similar bore 68 (passing twice through the cylindrical wall of the plug 26). When the bores 66 and 68 are in alignment, a pin 70 can be inserted therethrough, thus locking the member 42 in position within the plug 26.

Turning to FIG. 3, it will be noted that the rightward end of the elongate member 42 lies within a frusto-conical sleeve 72 which is integrally connected to the inside surface of the outer cylindrical wall at the first end 34 of the plug 26.

The diametrically opposed locations of the grooves 62 in the collar 28 would be selectively reserved for only one of the electrical polarities, namely: ground, neutral, and two or three "live" terminals.

It will be readily understood that various plugs for the different terminals can be made to fit only with the proper terminal by varying the angular separation between the external grooves 62. For example, one keyway on all collars 28 could be located at 12:00 o'clock, while the other keyway could be located at a radial separation of 180 degrees for ground, 65 degrees for neutral, one live phase at 210 degrees, the second live phase at 230 degrees, and the third live phase at 40 degrees. All angular locations are relative to the 12:00 o'clock position, which is defined as 0 degrees.

Figure 5:
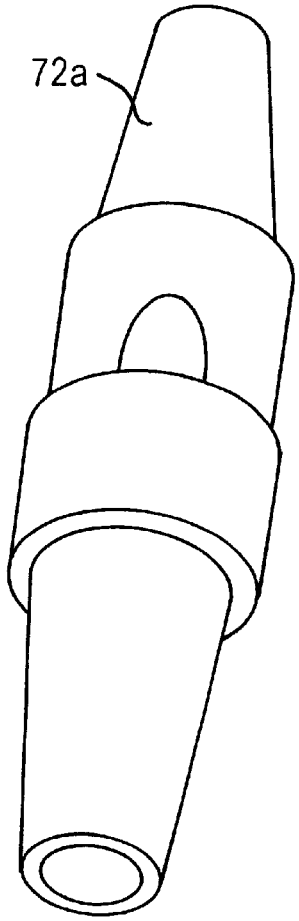
FIG. 5 (PRIOR ART)
FIG. 5 is a perspective view of a plug component forming part of the prior art.

As pointed out above, the adapter 24 provided by this invention is designed to fit snugly over an existing Cam-Lok® square flange receptacle (illustrated at 10 in FIG. 1). The existing mounting screws passing through mounting aperture 14 can be used to fix the adapter 24 in place. The adapter and the Cam-Lok® receptacle should be color-matched. An existing Cam-Lok® plug, of the kind shown in FIG. 5, can still be mated to the "adapted" receptacle. An environmental seal is still provided due to the resilient, external cone 72*a* which surrounds the leading portion of the elongate member 42 which carries the electrical current. In such a case, the adapter actually has no function.

It should be pointed out that, because of the internal configuration of the new plug mating end, the plug will mate easily with an unadapted Cam-Lok® receptacle. It will perform the same as the conventional Cam-Lok® plug, in that it has no keying capability and can be cross-plugged. Nonetheless, it does provide increased benefits relating to the ease of assembly, the proper cable strain relief, and the seal. However, mating this new plug with an adapted Cam-Lok® receptacle (as explained in detail above), provides the user with operator safety, i.e., the inability to cross-plug.

This invention allows the user to "phase in" safe connectors on equipment originally equipped with Cam-Lok® connector sets. Even if the equipment were utilized with non-upgraded cables for power distribution, mating can still take place without problems.

For new equipment, another receptacle having the features of adapter 24 integrally contained therein, which replicates an "adapted" Cam-Lok® receptacle can be installed directly onto new equipment and it will readily accept its "safe" mating plug. Even if a mating plug 26 is not available, a standard Cam-Lok® plug is still capable of mating with it.

Returning to FIG. 1, it will be noted that the rearward end 36 of the plug 26 defines an integral threaded portion 82, from which converging fingers 84 rearwardly extend.

A heavy duty back nut 86 has internal threads (not visible in FIG. 1) which engage the threads 82. As the back nut is screwed forwardly along the threads 82, it presses inwardly against the fingers 84, which in turn press inwardly against the jacket 88 of the electrical cable. (The jacket 88 being seen in FIG. 2). This inward pressure by the fingers 84 provides additional security holding the cable in place within the plug 26. A sealing sleeve 90 is provided, sized to receive the jacket 88 of any diameter cable, the sealing sleeve 90 being made of resilient material. When the backnut is screwed forwardly and fingers 84 are compressed, a waterproof seal is effected internally between the cable jacket and the inside of section 84.

It is pointed out that the plug and receptacle of the connector set provided herein are of comparable size to the existing Cam-Lok®: it has the same mounting footprint, the same protrusion from the panel, and the same color coding.

Figure 4:
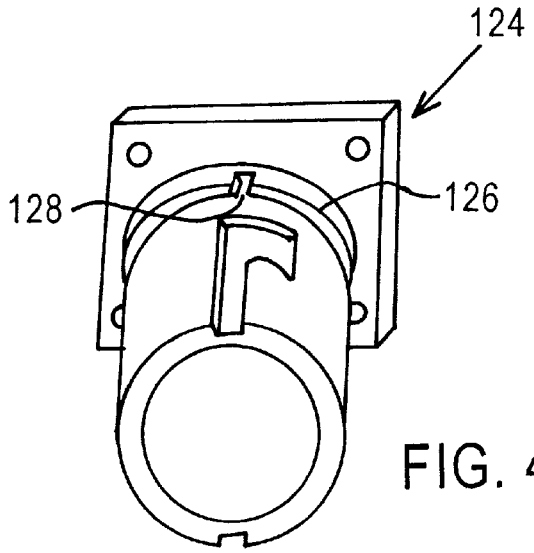
FIG. 4 is a perspective view of an adapter component for use in the invention, illustrating the optional incorporation of a safety lock.

An alternate adapter with additional means for locking the plug to the adapter is shown in FIG. 4. The adapter 124 shown in FIG. 4 has a raised ring 126 adjacent its base, the ring 126 having a groove 128. The mating plug can be provided with a spring-loaded plunger installed in the front end wall (not illustrated). This particular option is covered by U.S. Pat. No. 5,685,730, issued Nov. 11, 1997 and incorporated herein by reference. The plunger locks the plug to the receptacle when fully coupled, and requires a particular tool as disclosed in the '730 patent to enable the plug and receptacle to be disengaged.

The structural details given above provide the following advantages:

1. The keyed connections make it impossible to cross-plug.
2. An improved cable strain relief clamp and seal mechanism is provided.
3. The plug is easily assembled, by first removing the installation pin 70 to access the internal elongate member 42. The cable is passed through the connector body from the rear to the front. Then, the stripped cable end is terminated with set screws, following which the unit is repositioned within the plug body. The installation pin is reinserted, and the cable clamp back nut is tightened.
4. This construction provides optional safety lock means for preventing the accidental uncoupling of connectors. Since a tool is required, the uncoupling must be a deliberate act.
5. It allows intermateability with existing connectors.

While one embodiment of this invention has been illustrated in the accompanying drawings and described hereinabove, it will be evident to those skilled in the art that changes and modifications may be made therein, without departing from the essence of this invention, as set forth in the appended claims. For example, electrical receptacle 10 can be configured so that contact 18 is replaced with female conductive member 42 and plug 26 can be configured to include a conductive contact pin 18 having a rearward configuration similar to conductive member 42 shown in FIG. 2 to enable conductive member 42 to receive and retain the bare end of an electrical cable such as cable 54. All such embodiments are intended to be included within the spirit and scope of the invention claimed herein.

I claim:

1. An adapter for adapting a single pole electrical receptacle to receive a plug, the receptacle including a non-conductive mounting base, a non-conductive, substantially cylindrical sleeve extending from the mounting base, and a conductive contact pin positioned generally coaxially within the sleeve, the plug being elongate and having first and second ends, the first end enclosing an electrically conductive contact member which conductively engages the conductive contact pin when the first end of the plug is inserted in the cylindrical sleeve, the plug further having an attachment mechanism for connection to a cable and a retaining mechanism for retaining the first end of the plug in a desired position with respect to the collar, said adapter comprising:

a generally cylindrical collar snugly receivable over the sleeve of the receptacle;

a maintaining mechanism for maintaining said collar in a predetermined position on the sleeve; and a plug retaining mechanism for retaining the plug in a desired position with respect to said collar.

2. The adapter as claimed in claim 1, wherein said maintaining mechanism further includes a flange member affixed with respect to the sleeve, said flange member being mountable against the mounting base so as to restrain the sleeve against axial and rotational movement.

3. The adapter as claimed in claim 2, wherein the mounting base has fastening member apertures for mounting the mounting base to a mounting surface, and said flange member further includes adapter mounting apertures positioned correspondingly to the fastening member apertures for mounting said adapter to the mounting base.

4. The adapter as claimed in claim 1, wherein said plug retaining mechanism further includes at least one external L-shaped groove on said cylindrical collar and the first end of the plug defines a substantially cylindrical recess sized to receive said cylindrical collar.

5. The adapter as claimed in claim 4, wherein at least two said L-shaped grooves are peripherally separated by an angle defined by the nature of the single pole receptacle.

6. The adapter as claimed in claim 5, wherein the electrically conductive contact member is integrally provided at one end of a conductive elongate member within a bore and the other end of the elongate member integrally provides said attachment mechanism.

7. The adapter as claimed in claim 6, wherein the contact member is adapted to snugly envelop the contact pin when the recess in the first end of the plug receives said cylindrical collar, the contact pin and contract member being configured to define a cam joint, and the contact pin being bifurcated into two prongs.

8. The adapter as claimed in claim 1, wherein the predetermined position on the sleeve is a circumferential position.

9. The adapter as claimed in claim 1, wherein said plug retaining mechanism is adapted to receive a polarized plug.

10. In combination:

a single pole electrical receptacle comprising a non-conductive mounting base, a non-conductive, substantially cylindrical sleeve extending from the mounting base, and a conductive contact pin positioned generally coaxially within the sleeve;

an adapter having a generally cylindrical collar snugly receivable over the sleeve of the receptacle, and including a maintaining mechanism for maintaining the collar in a predetermined position on the sleeve;

an elongate plug having first and second ends, the first end defining a substantially cylindrical recess sized to receive said cylindrical collar, the first end also enclosing an electrically conductive contact member which conductively engages the contact pin when the first end of said plug receives the collar, said plug further having an attachment mechanism for connection to a cable, the attachment mechanism establishing electrical contact between the cable and the contact member, and thus between the cable and the contact pin; and a retaining mechanism for retaining the first end of the plug in a desired position with respect to the collar.

11. The adapter as claimed in claim 10, wherein said retaining mechanism is adapted to receive a polarized plug.

12. The invention claimed in claim 8, in which the maintaining mechanism includes a flange member affixed with respect to the sleeve, the flange member being mountable against the mounting base so as to restrain the sleeve against axial and rotational movement; and in which the mounting base has fastening member apertures to secure the base to a substrate; the flange member having adapter apertures positioned correspondingly to the fastening member apertures for positioning the flange member next to the mounting base.

13. The invention claimed in claim 8, in which the recess provides one end of an axial bore which opens through the second end of said plug; the electrically conductive contact member being integrally provided at one end of a conductive elongate member within the bore, the other end of the elongate member integrally providing the attachment mechanism; the contact member being adapted to snugly envelop the contact pin when the recess in the first end of said plug receives the cylindrical collar, the contact pin and contact member being configured to define a snug electrical connection; the contact pin being bifurcated into two prongs.

* * * * *